US008276627B2

(12) United States Patent
Gaffney

(10) Patent No.: US 8,276,627 B2
(45) Date of Patent: Oct. 2, 2012

(54) GOLF CLUB HEAD COVER WITH SNAP CLOSURE

(76) Inventor: Travis Gaffney, Tempe, AZ (US)

( * ) Notice: Subject to any disclaimer, the term of this patent is extended or adjusted under 35 U.S.C. 154(b) by 16 days.

(21) Appl. No.: 12/079,839

(22) Filed: Mar. 28, 2008

(65) Prior Publication Data

US 2009/0242089 A1 Oct. 1, 2009

(51) Int. Cl.
*A63B 57/00* (2006.01)

(52) U.S. Cl. ..... 150/160; 150/154; 150/159; 206/315.4; 206/315.3

(58) Field of Classification Search ..... 150/154, 150/160, 159; 206/315.4, 315.3; D21/754
See application file for complete search history.

(56) References Cited

U.S. PATENT DOCUMENTS

| | | | | |
|---|---|---|---|---|
| 2,508,525 | A * | 5/1950 | Le Fevre | 150/160 |
| 2,705,039 | A * | 3/1955 | Halter | 150/160 |
| 3,023,795 | A * | 3/1962 | Denkert | 150/160 |
| 3,255,794 | A * | 6/1966 | Morse | 150/160 |
| 3,593,769 | A * | 7/1971 | Spears | 150/160 |
| 4,898,222 | A * | 2/1990 | Gaffney | 150/160 |
| 5,284,194 | A | 2/1994 | Gaffney | |
| 5,738,157 | A | 4/1998 | Gaffney | |
| 5,941,293 | A | 8/1999 | Serpa | |
| 6,044,880 | A | 4/2000 | Maeng | |
| 6,095,214 | A | 8/2000 | Gaffney | |
| 6,116,307 | A * | 9/2000 | Mangigian et al. | 150/160 |
| 6,192,950 | B1 | 2/2001 | Maeng | |
| 6,202,723 | B1 * | 3/2001 | Maeng | 150/160 |
| 6,321,805 | B1 * | 11/2001 | Suggs | 150/160 |
| 6,352,485 | B1 * | 3/2002 | Philpot et al. | 473/564 |
| 6,772,811 | B1 | 8/2004 | Kim | |
| 6,793,072 | B2 | 9/2004 | Maeng | |
| 6,874,627 | B2 * | 4/2005 | Maeng | 206/315.2 |
| 6,942,580 | B2 * | 9/2005 | Hou et al. | 473/332 |
| 7,188,647 | B2 * | 3/2007 | Bradshaw | 150/160 |
| 2003/0075252 | A1 * | 4/2003 | Noyes | 150/160 |
| 2003/0136485 | A1 | 7/2003 | Bradshaw | |
| 2004/0206433 | A1 * | 10/2004 | Kim | 150/160 |

(Continued)

FOREIGN PATENT DOCUMENTS

| | | | |
|---|---|---|---|
| CN | 2922956 | Y | 4/2006 |

(Continued)

*Primary Examiner* — Anthony Stashick
*Assistant Examiner* — Cynthia Collado
(74) *Attorney, Agent, or Firm* — Adam R. Stephenson, Ltd.

(57) ABSTRACT

There is provided a golf club cover with a magnetized snap closure that provides a functional but convenient and attractive method for affixing and removing a cover from the head of a golf club, particularly a putter. A golfer need only align the golf club, such as by pointing the tip of a putter head toward the opening in the cover, and then quickly push the club head right through the opening and into an internal cavity of the cover. Two matching arm fasteners are disposed in opposing flaps of the cover. The arm fastener includes a flange portion and a magnet with the magnets serving to maintain the arm fasteners in a generally engaged position. Movement of the club shaft toward the interior of the cover will cause the magnetic snap closure to briefly open so as to allow the shaft to pass through the closure. Then, once the shaft has passed the closure, meaning that the head of the club has reached its resting place in the cover cavity, the snap closure then automatically (magnetically) closes so as to secure the golf club cover around the club head. In order to remove the club from the cover, the user quickly pulls the club away, which sufficiently opens the snap closure and allows the club to be extricated from the cover.

7 Claims, 11 Drawing Sheets

U.S. PATENT DOCUMENTS

2005/0016648 A1 1/2005 Vakharia et al.
2006/0201596 A1* 9/2006 Hwang ..... 150/160
2007/0023116 A1 2/2007 Chen
2007/0068611 A1* 3/2007 Hwang ..... 150/160
2007/0137959 A1* 6/2007 Zauderer ..... 190/110
2007/0277353 A1* 12/2007 Kondo et al. ..... 24/403

FOREIGN PATENT DOCUMENTS

KR WO2006132482 12/2006

* cited by examiner

GOLF CLUB HEAD COVER WITH SNAP CLOSURE

FIELD OF THE INVENTION

The present invention relates to sporting equipment. More particularly the present invention relates to golf clubs and to a golf club cover with a snap closure configured to protect the heads of golf clubs, and wherein the cover is particularly adapted for use with putters.

BACKGROUND OF THE INVENTION

Recreational activities and outdoor activities are popular pass times in contemporary life. Golfing, boating, camping, and other sports-related activities are examples of popular recreational activities. Golfing, to take one example, is a very significant economic factor in American recreation. A Dec. 22, 2002 Report from SRI International, titled Golf Economy Report, states that "The U.S. golf economy is significant, accounting for $62.2 billion worth of goods and services in the year 2000."

In pursuing the game of golf, golfers typically carry a set of the various clubs required to play the game in a bag into which the club handles are inserted after inverting the club to cause the heads to extend out of the open end of the bag. When the bags are carried from place to place, the heads are repeatedly struck and battered. This also occurs when clubs are removed and inserted into the bag. "Sock" types of golf club covers have been constructed particularly for protecting the woods. These socks generally have an elastic neck on them to hold them in place over the wood when it is in the bag. They are readily and easily removed from the woods. In some cases, a draw string type of fastener is employed to secure the cover over the head and to prevent it from being accidentally dislodged.

It is much more difficult to provide a cover which is quickly installed and quickly removed from the heads of irons and putters. A protective cover for putters, in particular, is desirable since these are the shortest clubs in the bag and are repeatedly struck and battered. In addition, some golf putters have heads made of brass or other readily scratched or dented and scuffed material, so that protection is highly desirable. Putters in particular may have inserts in their faces which it would be desired to protect from banging and damage.

Due to the shape of irons and putters, however, it has been difficult to provide a cover which could be quickly and conveniently held in place and readily removed. For example, irons have a front or toe portion which is relatively larger than the rear or heel portion, and are connected to the shaft at the heel portion end. Consequently, if an access opening is sized large enough to receive the toe portion of the club, the cover fits so loosely about the shaft of the club, that the cover frequently is inadvertently removed from the head of the iron or putter in which it is used.

There also exists an ongoing need to improve the design of golf club covers and putter covers in particular. The putter is the one club that is almost always used on every hole. Thus the cover for that club is repeatedly taken off and put on during a round of golf. It would be desirable to provide a protective cover for golf clubs, particularly for irons and putters of all types, which provides the desired protection, which stays in place, and which is easy and quick to put on and to remove.

Hence there has been identified a need to provide an improved golf club cover. It would be desired to provide a type of cover that could be used with a variety of club head configurations. It would further be desired to provide a golf club cover that, while providing a strong and robust degree of protection to the golf club, may nevertheless be quickly and easily placed and removed from the golf club. It is further desired that a golf club cover be designed and configured so that it will stay in place, over the golf club head, during normal transportation and storage of the golf clubs. The present invention addresses one or more of these needs.

SUMMARY OF THE INVENTION

In broad terms, the golf club cover with a snap closure provides a functional but also convenient and attractive method for affixing and removing a cover from the head of a golf club. A golfer need only align the golf club, such as by pointing the tip of a putter head toward the opening in the cover, and then quickly push the head right through the opening and into the internal cavity where the head comes to rest. The shaft of the golf club will cause a magnetic snap closure to briefly open so as to allow the shaft to pass through the closure. Then, once the shaft has passed the closure, meaning that the head of the club has reached its resting place in the cover cavity, the snap closure then automatically (magnetically) closes so as to secure the golf club cover around the club head. It has been found that the rapidity, quickness, and robustness of the magnetized snap closure is functionally and esthetically appealing to golfers.

In accordance with one aspect of the present invention, and by way of example only, there is provided a golf club head cover for covering the head of a golf club having a head attached to a shaft, wherein the cover is capable of transitioning between an engaged and a disengaged position, the cover comprises: a body portion defining an internal cavity for receiving a golf club head; a first flap disposed on the body portion; a second flap disposed on the body portion; a first pocket disposed on the first flap; a second pocket disposed on the second flap; a first arm fastener disposed in the first pocket; a second arm fastener disposed in the second pocket; wherein the first pocket and the second pocket are configured such that the first arm fastener is closely held in position within the first pocket, and wherein the second arm fastener is closely held in position within the second pocket, such that the first arm fastener and the second arm fastener substantially align with each other; and wherein the body portion further defines an opening through which the golf club head may pass when entering and leaving the internal cavity. The body portion may define a notch area. The first arm fastener may comprise a flange and at least one magnet, and the second arm fastener may also comprise a flange and at least one magnet. Preferably, the first arm fastener and the second arm fastener are aligned so as to engage and disengage. The flange of the first arm fastener and the flange of the second arm fastener may each have a curved end such that the first arm fastener and the second arm fastener define a y-shaped opening when engaged. Additionally, the flanges may have curves at both ends, such that the first arm fastener and the second arm fastener define a first y-shaped opening and a second y-shaped opening when engaged. The flange may be made of a plastic or metallic material; metallic materials may additionally be magnetic or nonmagnetic. The magnet used in the arm fastener may be substantially circular in shape, and alternatively may be substantially rectangular. The golf club head cover may also have a low friction material positioned on the first flap and the second flap proximate the opening so as to allow a golf club to more easily pass through this area.

In another aspect of the present invention, still by way of example only, there is provided a golf club head cover for covering golf clubs having a head attached to a shaft, wherein the cover includes as elements: a body portion defining an internal cavity for receiving a golf club head; a first flap disposed on the body portion; a second flap disposed on the body portion; a first arm fastener disposed on the first flap; and a second arm fastener disposed in the second flap. The golf club head cover may further include a first pocket disposed on the first flap and a second pocket disposed on the second flap, such that the first arm fastener is disposed in the first pocket and the second arm fastener is disposed in the second pocket. Alternatively the first arm fastener and the second arm fastener are glued to the body portion. Alternatively, the first arm fastener and the second arm fastener are stitched to the body portion. When following the pocket embodiment, the first pocket and the second pocket are configured such that the first arm fastener is closely held in position within the first pocket and the second arm fastener is closely held in position within the second pocket, such that the first arm fastener and the second arm fastener substantially align with each other. The first arm fastener and the second arm fastener may comprise a flange and at least one magnet.

In still a further aspect of the present invention, and still by way of example only, there is provided a method for securing a golf club head cover over the head of a golf club that includes the steps of: positioning the shaft of a golf club in the y-shaped area defined by a first arm fastener and a second arm fastener; pushing the shaft of the golf club through the y-shaped area defined by the first arm fastener and second arm fastener, thereby transitioning the first arm fastener and the second arm fastener from an engaged position to a disengaged position; and further pushing the shaft of the golf club through and past the first arm fastener and the second arm fastener, thereby pushing the golf club head into a receiving cavity and also thereby allowing the first arm fastener and the second arm fastener to automatically transition from the disengaged position to the engaged position so as to secure the head cover in place over the golf club head. The method may further include the step of passing the golf club head through a notch area of the golf club head cover. Additionally, the method may also include the step of removing the golf club head from the golf club head cover.

Other independent features and advantages of the golf club cover with a snap closure will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

Figure 1:
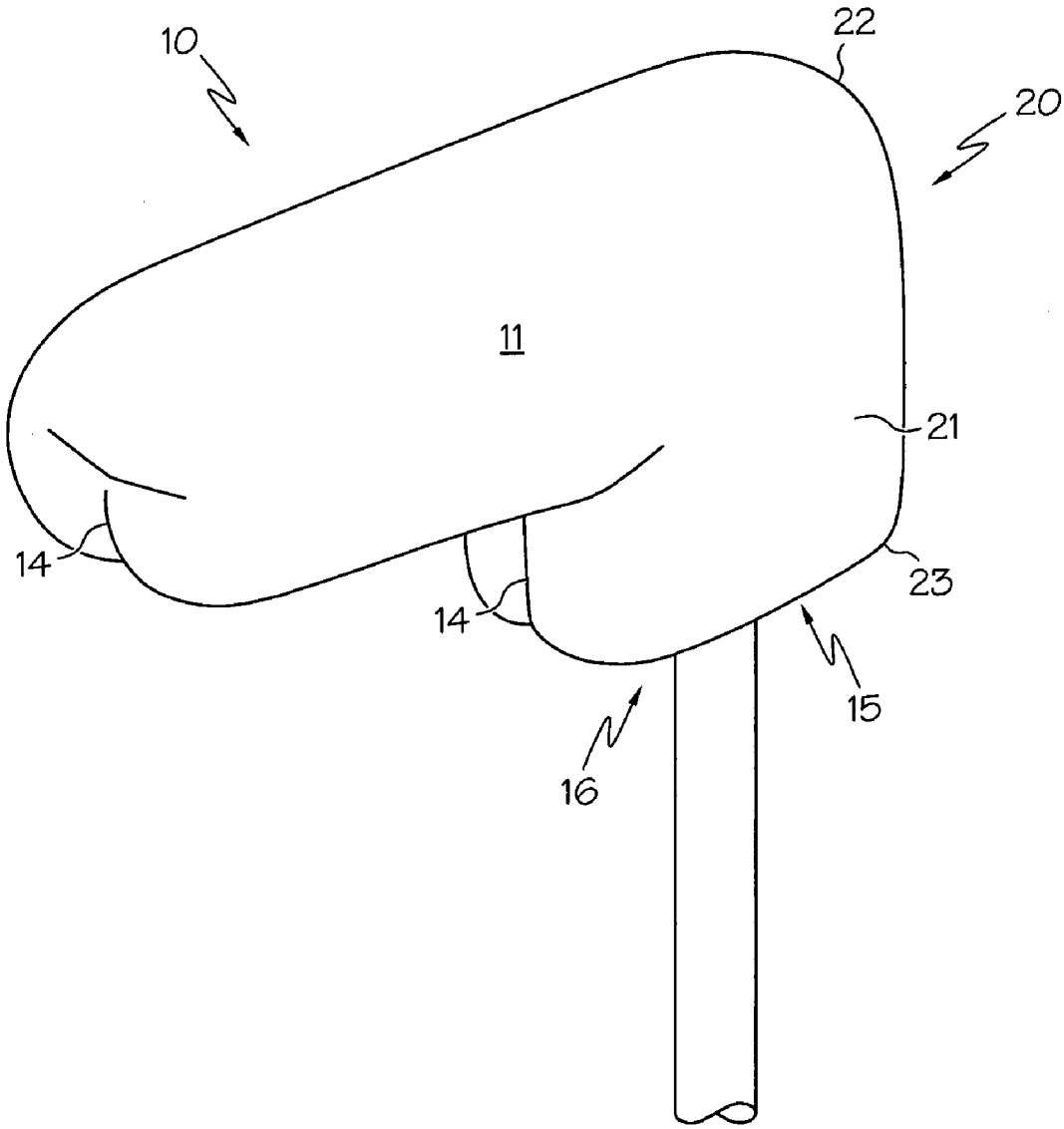
FIG. 1 is a perspective view of a golf club cover and golf club head, according to an embodiment of the present invention.
Figure 2:
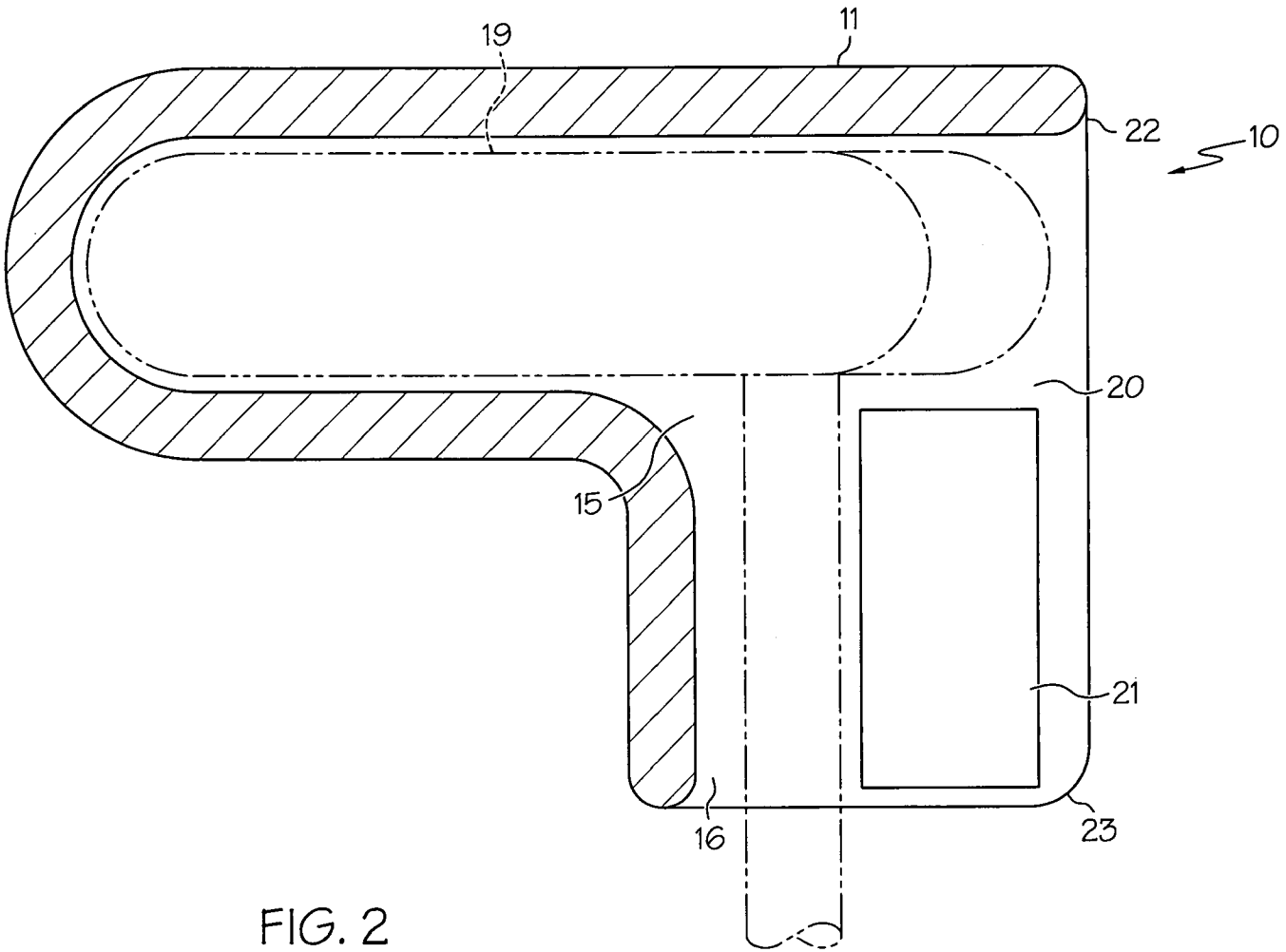
FIG. 2 is a further perspective view of a golf club cover and golf club head, according to an embodiment of the present invention.

Referring initially to FIGS. 1 and 2 there is shown a view of an exemplary golf club head cover 10. Cover 10 includes a main body portion 11 configured so as to define an internal cavity 15. Cavity 15 defines the space in which the head 19 of a golf club, such as a putter head 19, can be positioned. Body 11 of cover 10 can advantageously be formed of a single piece of material folded along one or more seams 14. Additionally, cover 10 may include multiple layers or laminates of materials. In a preferred embodiment, an outer layer of material provides a water proof or weather proof protection while an interior layer of a fleece-like or cushioned material provides a protective layer around cavity 15 for receiving head 19 of a golf club.

In a preferred embodiment, cover 10 includes opening 20. Opening 20 is defined by opposing flaps 21 which are wing-like structures of cover 10. While flaps 21 are just an extension of main body portion 11, flaps 21 are generally secured at an upper position proximate to top 22 of cover 10; and at the lower corner 23 are loose and unsecured. Thus, flaps 21 are generally free to open and close around opening 20 with more freedom of movement at corners 23 than at top 22. Cover 10 also preferably includes shaft opening 16, positioned generally toward the bottom or lower portion of cover 10, where the shaft of a golf club can be positioned when the cover is on the club.

Figure 3:
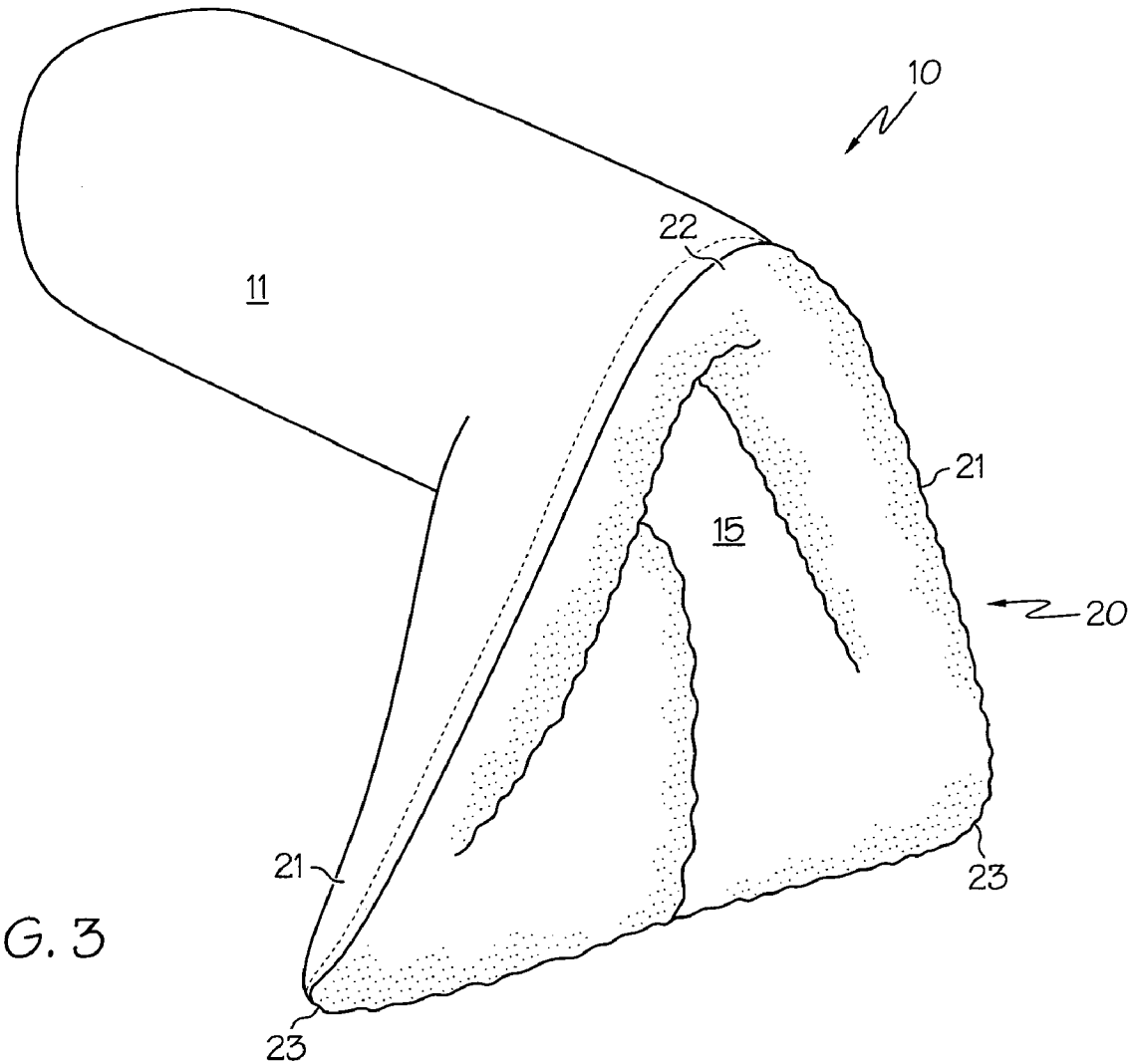
FIG. 3 is a further perspective view of a golf club cover showing an opening, according to an embodiment of the present invention.

Referring to FIG. 3 it is observed that opening 20 provides a point of access through which a golf club can be inserted into and removed from cavity 15. As previously described in U.S. Pat. No. 4,898,222 (commonly assigned to the assignee of the present application, Arizona Manufacturing and Embroidery, LLC) and which is hereby incorporated by reference, the head 19 of a putter can be inserted into an removed from a cavity 15 of cover 10. Further, the '222 patent described how strips of material with a fastener surface such as hook-and-loop material (commonly referred to as VEL- CRO® fasteners) could be used to secure flaps 21 in their closed position. In this manner, a golf club cover 10 could be securely held over a putter head 19. However, it has now been discovered that a golf club cover 10 can be secured to a golf club through an alternative novel means.

Figure 4:
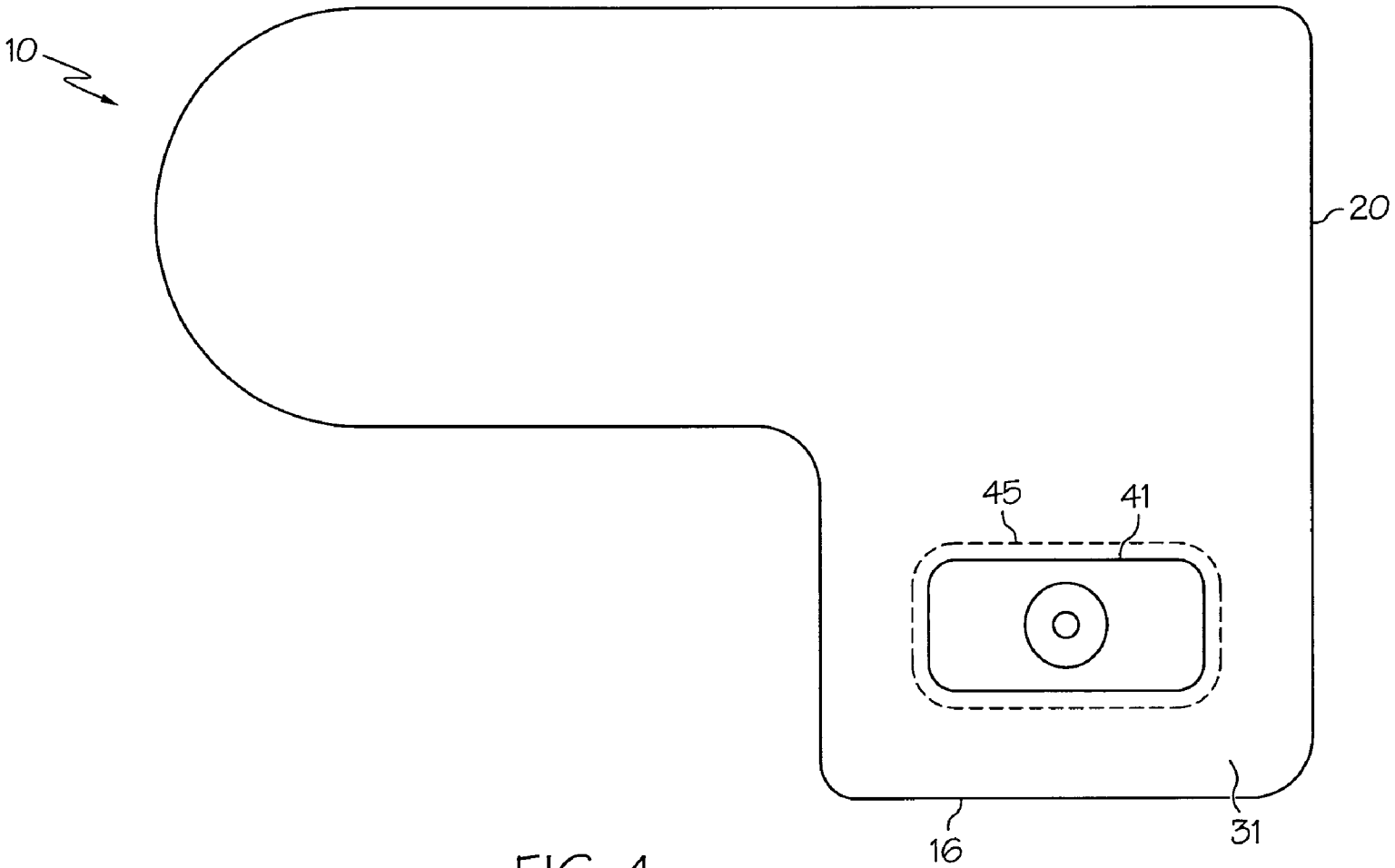
FIG. 4 is a perspective view of a cover having a pair of arm fasteners, according to an embodiment of the present invention.
Figure 5:
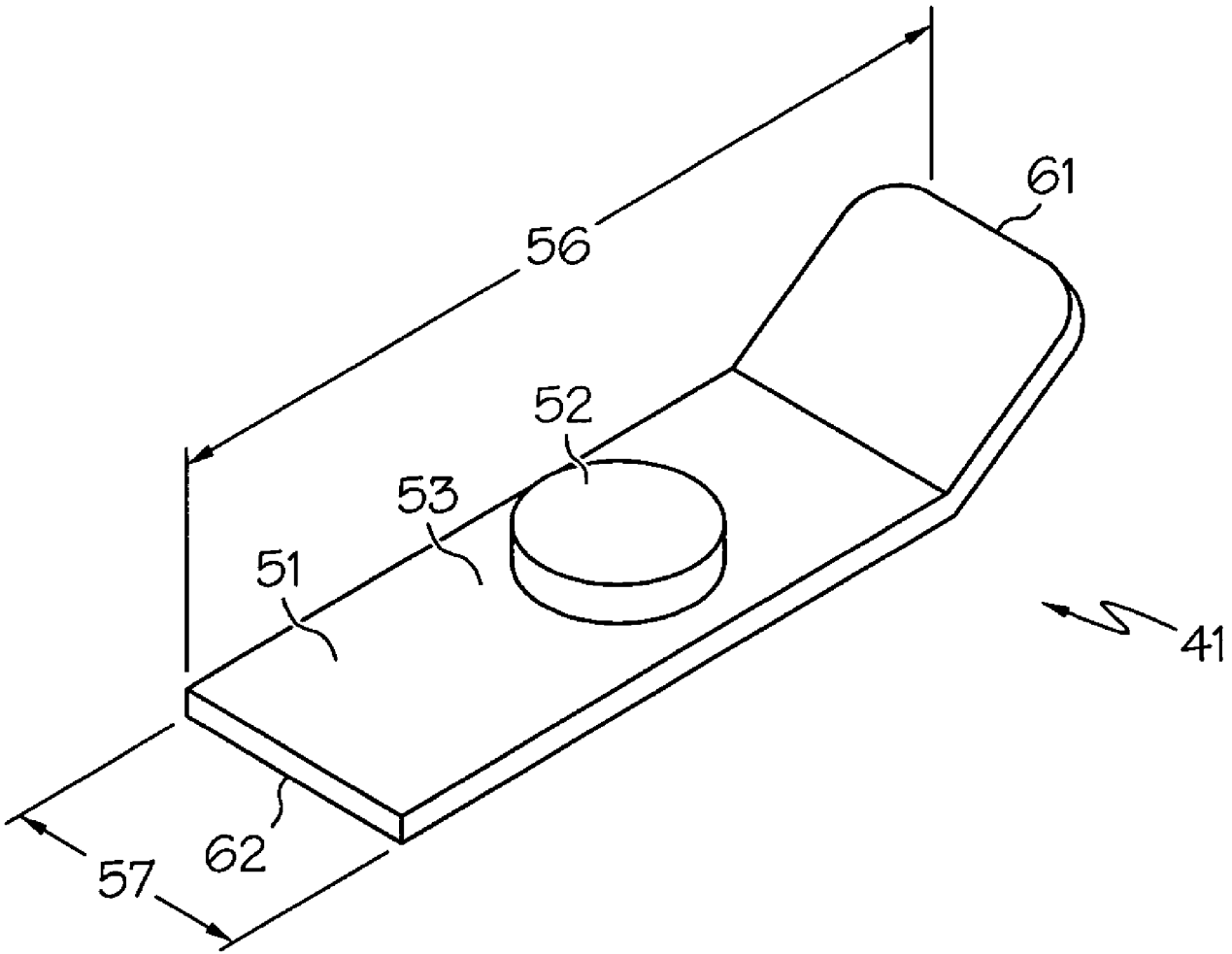
FIG. 5 is a perspective view of an arm fastener, according to an embodiment of the present invention.
Figure 6:
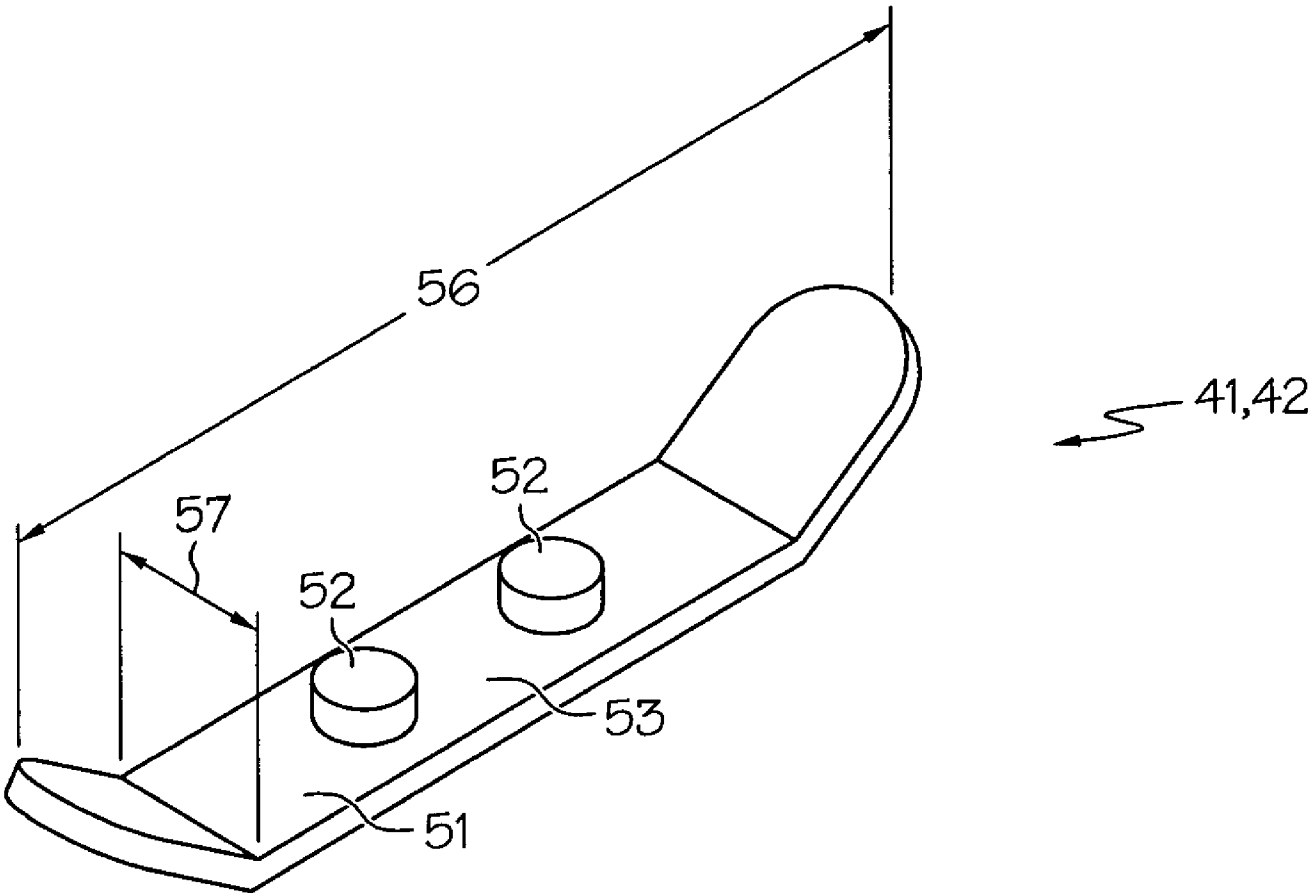
FIG. 6 is a perspective view of an arm fastener (fastener) having flange with two curved edges, according to an embodiment of the present invention.

Referring next to FIG. 4, there is shown an exemplary embodiment of cover 10 having a pair of arm fasteners 41, 42 positioned therein. Arm fasteners 41 are also illustrated in FIG. 5. In a preferred embodiment, a first or left arm fastener 41 is positioned in a first or left flap 31, and a second or right fastener 42 is positioned in a second or right flap 32. Fasteners, 41, 42 are further illustrated in FIG. 5 which shows a preferred embodiment of each of fastener 41, 42 to comprise a flange 51 and magnet 52. Flange 51 is preferably an elongate thin piece of metal. As shown in FIG. 5, flange 51 can have a curved end 61 and a straight end 62. However, as shown in FIG. 6, flange 51 may also include two curved edges. In the embodiment that includes a curved end 61 and straight end 62, curved end 61 is preferably positioned toward the opening 20 of cover 10 so as to create a y-shaped area as further defined herein. Referring to FIGS. 5 and 6, also present in flange 51 is a central or body portion 53. The central, body portion 53 of flange 51 preferably defines a generally flat or planar portion of the flange 51.

Figure 7:
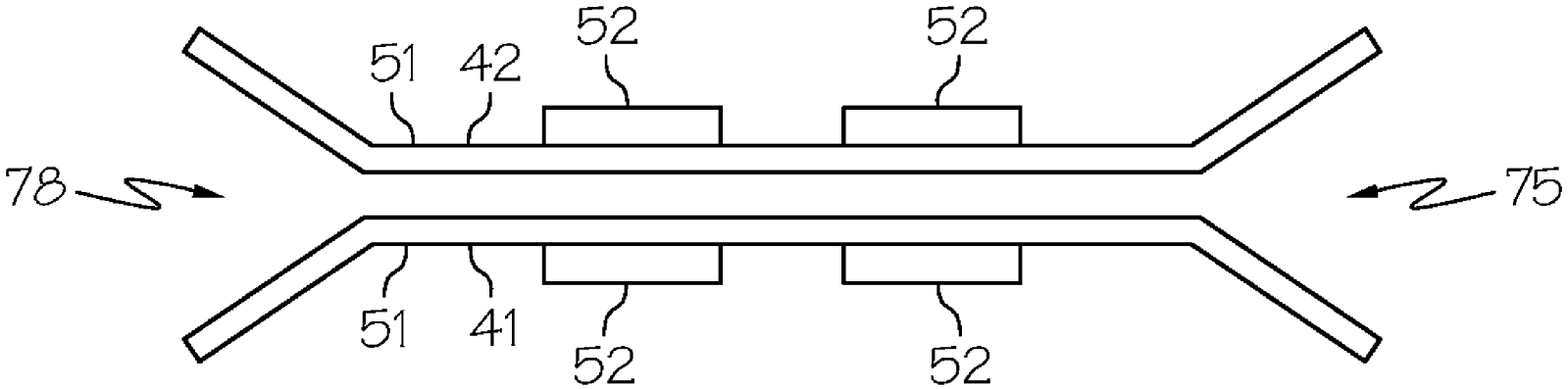
FIG. 7 is a side view of a pair of arm fasteners having flanges with double curved edges, according to an embodiment of the present invention.

It is further noted in FIG. 5 that the curved end 61 of flange 51 may also be set so that it curves or bends away from the plane established by the central or body portion 53 of flange 51. Further, it is preferred that each of fasteners 41 and 42 are positioned, one with respect to the other, such that curved ends 61 of each fastener 41, 42 form a generally Y-shaped opening 75. FIG. 7 illustrates a paired set of fasteners 41, and 42, viewed from above, with the material of cover 10 not shown. Thus, FIG. 7 shows the preferred spatial arrangement of each of fasteners 41 and 42 in which they define Y-shaped opening (first y-shaped opening) 75. As will be described with respect to the operation of embodiments of the invention, the configuration that creates the Y-shaped opening 75 is very useful in allowing a shaft of a golf club to be quickly placed within the Y-shaped opening 75 area, and then later pushed past and through the Y-shaped opening 75—thus securing the cover 10 over the golf club. Hence the general size of the area defined by fasteners 41 and 42 together with Y-shaped opening 75 is such an area or space sufficient to receive a golf club shaft. As illustrated in FIG. 7, fasteners 41 and 42 that have two curved ends may also define a second y-shaped opening 78 that may have dimensions similar to the first y-shaped opening 75. Finally, it is noted that the offsetting angle (relative to central body portion 53) defined by curved end 61 may be a generally straight or a generally curved angle.

With respect to the overall shape and dimensions of various embodiments of flanges 51, it is noted that they can take a number of different configurations. Generally, and referring to FIGS. 5 and 6, it is preferred that embodiments of flanges 51 be generally rectangular in overall shape such that the width dimension 56 is somewhat greater than the height dimension 57. It is noted that the width dimension 56 is measured from the flat end 62 to the farthest point of extension of a rounded end 61. Alternatively, when two rounded edges are present, it may be measured from a first rounded end point to the opposite rounded end point. While this rectangular shape is a preferred embodiment, and has been found functional for the intended purpose of securing covers over golf clubs, other configurations, such as square, are possible. With respect to the thickness of embodiments of flanges 51, a variety of thicknesses are possible so as to allow the snap closure to function for its intended purpose, yet without adding unnecessary weight or expense to the device. For example, embodiments with a thickness of approximately under $\frac{1}{8}^{th}$ inch have been found to function successfully.

Embodiments of flanges 51 may comprise a metallic material. Further the metallic material that may be selected may be a material to which a magnetic would affix. However, non-magnetic metals may also be used. In other embodiments, it is also possible to compose the flange 51 of a nonmetallic material such as a plastic.

Referring again to FIG. 5, it is noted that magnet 52 is positioned so as to generally rest in the area defined by central body portion 53 of flange 51. Magnets 52 may take a variety of shapes; however, a generally circular shape has been found to function for the intended purpose. Further, while more than one magnet 52 may be used per flange 51, it has also been found that the pairing of a single magnet 52 with a single flange 51 is sufficient for the intended purpose. The strength (magnetic force) of the magnet 52 is an important feature in selecting the size and dimensions of the magnet 52. As will be explained further herein, the force of magnetic attraction between opposing and paired sets of flange and magnet will provide the force that allows the snap closure to function for its intended purpose. Thus, the desired force of the magnet 52 may generally be described as sufficiently strong so as to hold two paired arm fasteners 41 and 42 together, thereby holding left flap 31 and right flap 32 closed, and thereby holding the cover 10 on the golf club head during normal operation. However, the force of the magnet 52 should not be so strong so as to prevent a user (in normal usage) from being able to push the club through the snap closure when putting the cover on the golf club head, and conversely the force of the magnet 52 should not be so strong so as to prevent a user (in normal usage) from being able to pull the club through the snap closure when removing the cover from the golf club head. The magnets may or may not be permanently attached to their respective flanges. In a preferred embodiment, a magnet is glued to its respective flange.

Referring again to FIG. 4, it is noted that fasteners 41 and 42 are positioned in cover 10. In one embodiment, cover 10 is fashioned with pockets 45 and 46 in which fasteners 41 and 42 are positioned. It is noted that first pocket 45 is generally positioned in first flap 31, and second pocket 46 is generally positioned in second flap 32. In such an embodiment, each pocket 45 and 46 is shaped so that the gross external shape of pocket 45 and 46 can receive and hold fastener 41 and 42 in a generally desired position. Thus, pockets 45 and 46 are positioned with respect to cover 10 such that left fastener 41 will generally align with right fastener 42. Once a fastener 41 and 42 is placed in a pocket 45 and 46, the pocket 45 and 46 may be sealed shut such that the fastener 41 and 42 cannot escape from the pocket 45 and 46. While placing fasteners 41 and 42 in pockets 45 and 46 is the preferred method of securing fasteners 41 and 42 with respect to cover 10, other methods of securing may be used. For example, fasteners 41 and 42 may be glued to a fabric or substrate included within cover 10. Alternatively fastener 41 and 42 may be stitched to a portion of cover 10. Where, for example, flange 51 includes a flexible material, such as a plastic, the stitching method of attachment may be used. Other means of securing are also possible. However, regardless of the means used to secure fasteners 41 and 42 to cover 10, the fasteners 41 and 42 should be placed in a desired relationship configuration such that the fasteners 41 and 42 can mutually attract and attach to one another as further described herein.

Figure 8:
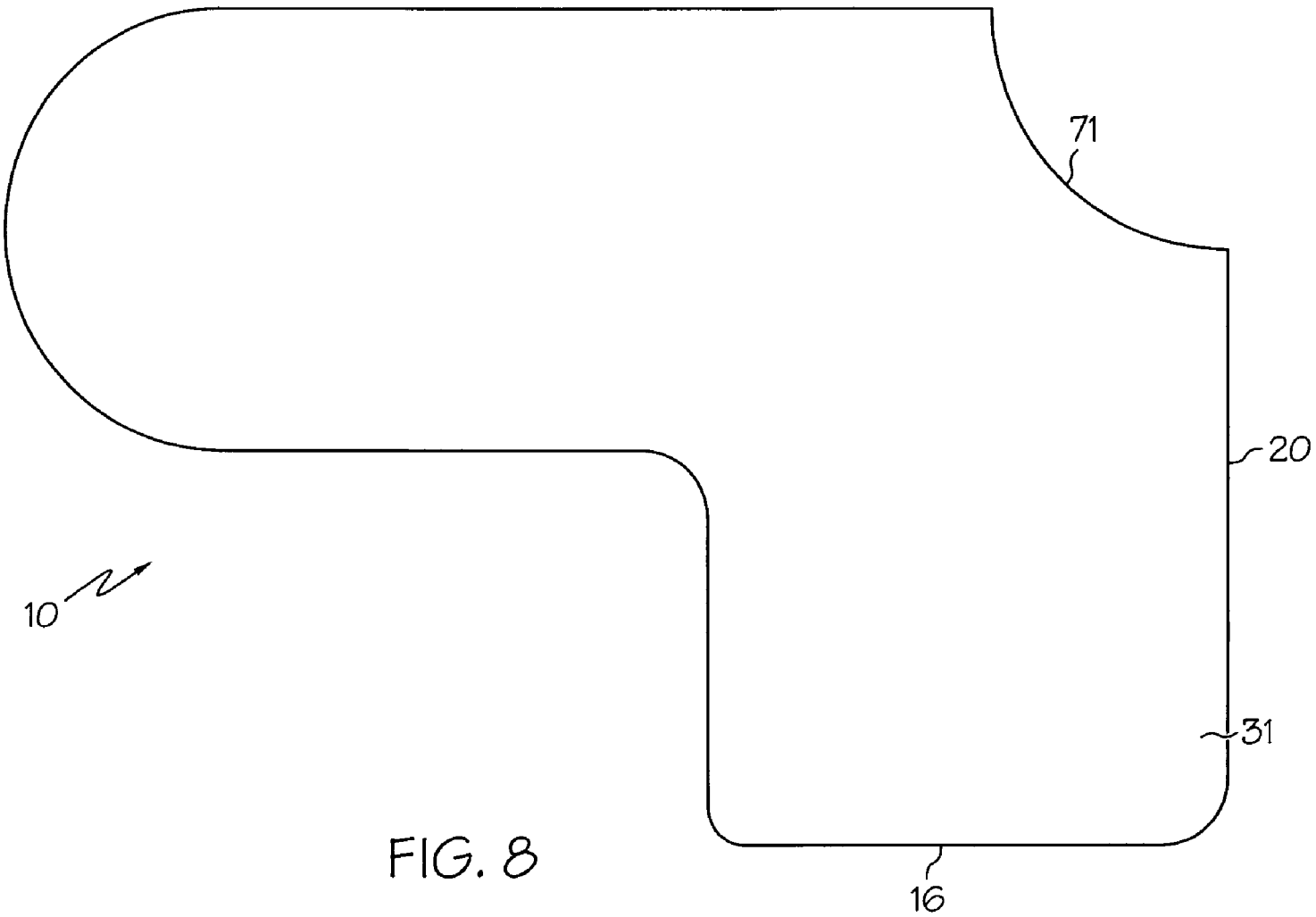
FIG. 8 is a perspective view of a golf club head cover having a notch feature, according to an embodiment of the present invention.

In a further embodiment shown in FIG. 8, it is noted that cover 10 may be provided with notch 71. Notch 71 is a generally arcuate or cut away region in the upper corner of cover 10. Notch 71 is generally positioned in that area of cover 10 through which a putter head passes when the putter head is secured and removed from cover 10. Functionally, notch 71 serves to provide an increased area or roominess through which the putter head can pass. This increased area or roominess is noted in contrast to the covers 10 that do not include notch 71. In such a notchless embodiment, left flap 31 and right flap 32 generally come into proximity to each other. However, when a notch 71 is provided in the upper corner of cover 10, the act of removing material from each of left flap 31 and right flap 32, so as to create notch 71, relaxes somewhat the alignment of left flap 31 and right flap 32 in the corner area. Thus, in the area of notch 71, there is an increased space. This increased space is functional, particularly in the embodiments with the snap fastener described herein, in that it allows the putter head to more quickly snap through the closure, without encountering significant resistance from the cover itself. Thus, the desired result, a smooth but effective snap through placement of the cover, on and off the golf club head, is achieved.

Having described the golf club cover from a structural standpoint, a preferred method of using the golf club cover will now be described. In broad and general terms, the golf club cover with a snap closure provides a functional but convenient method for affixing and removing a cover from the head of a golf club. A golfer need only align the golf club, such as by pointing the tip of a putter head 19 toward the opening 20, and then quickly push the head 19 through the opening 20 and into internal cavity 15. The shaft 18 of the golf club will cause the magnetic snap closure 41, 42 to briefly open so as to allow the shaft 18 to pass through the closure. Then, once the shaft 18 has passed the closure, meaning that the head 19 of the club has reached its resting place in the cover cavity 15, the snap closure then automatically (magnetically) closes so as to secure the golf club cover 10 around the club head 19. It has been found that the rapidity, quickness, and robustness of the magnetized snap closure is functionally and esthetically appealing to a golfer.

Figure 9:
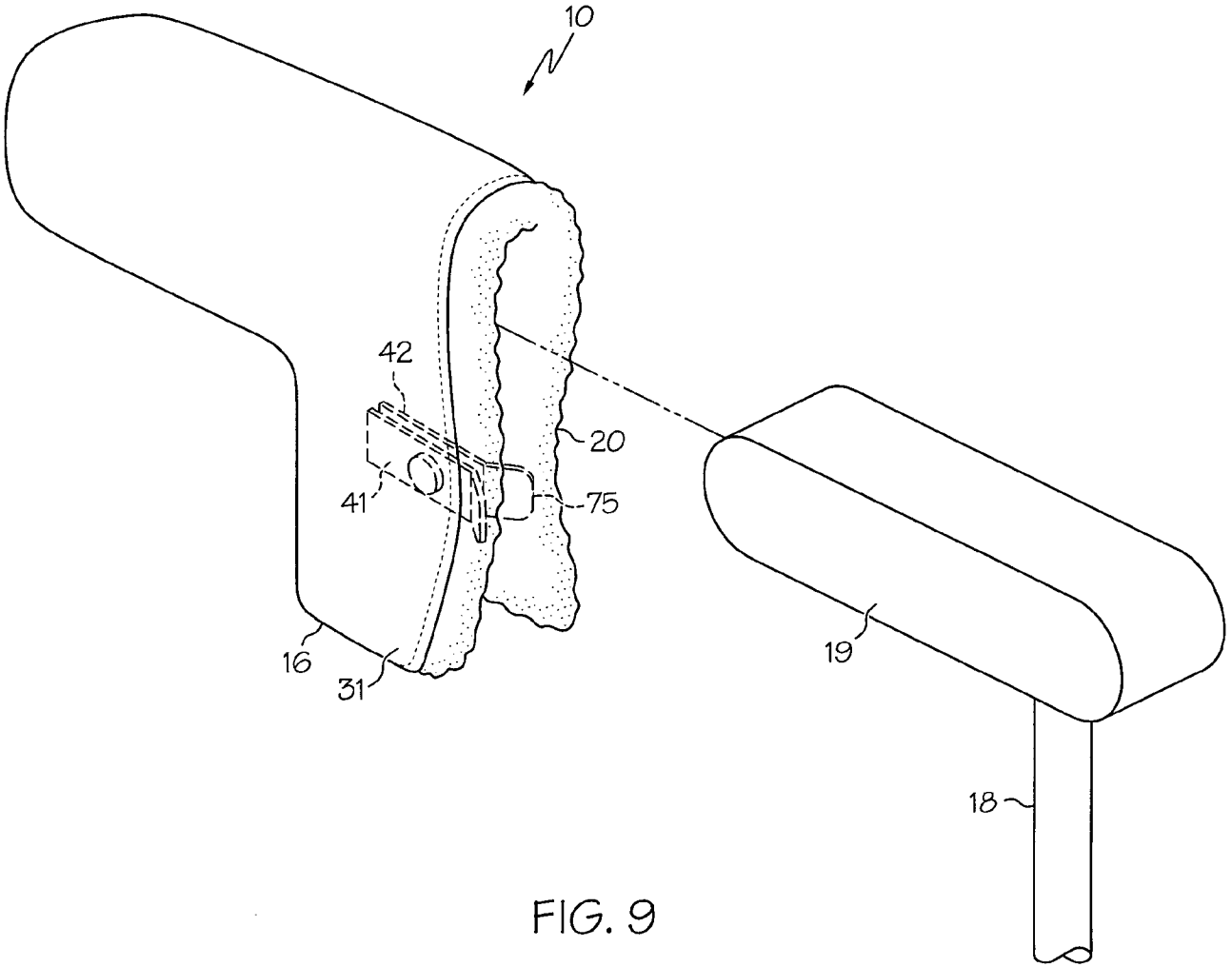
FIG. 9 is a perspective view of a golf club head cover with a golf club head in alignment therewith, according to an embodiment of the present invention.

Referring first to FIG. 9 a golf club head is shown in alignment with cover 10; in this position, the golf club head is ready to be pushed into the cover 10. It is noted that the snap closure is in the engaged or closed position; i.e., first arm fastener 41 is aligned with and magnetically connected to second arm fastener 42. The magnetic attraction between first arm fastener 41 and second arm fastener 42 is such that first flap 31 is held against second flap 32, thereby keeping opening 20 in a generally closed position. In FIG. 9 it is further noted that the tip of the golf club head 19 is aligned with notch 71 of cover 10 so that the golf club head 19 can then be pushed through this area. It is also noted that the shaft 18 of the golf club is generally aligned with opening 20, so that shaft 18 can also be pushed through that area. Also, shaft 18 is generally positioned proximate y-shaped opening 75. The general position shown in FIG. 9 is something of a preliminary or priming position. A human user can align the club as in this figure, and then, with a quick forward snap, engage cover 10 with the golf club head as further described herein.

Figure 10:
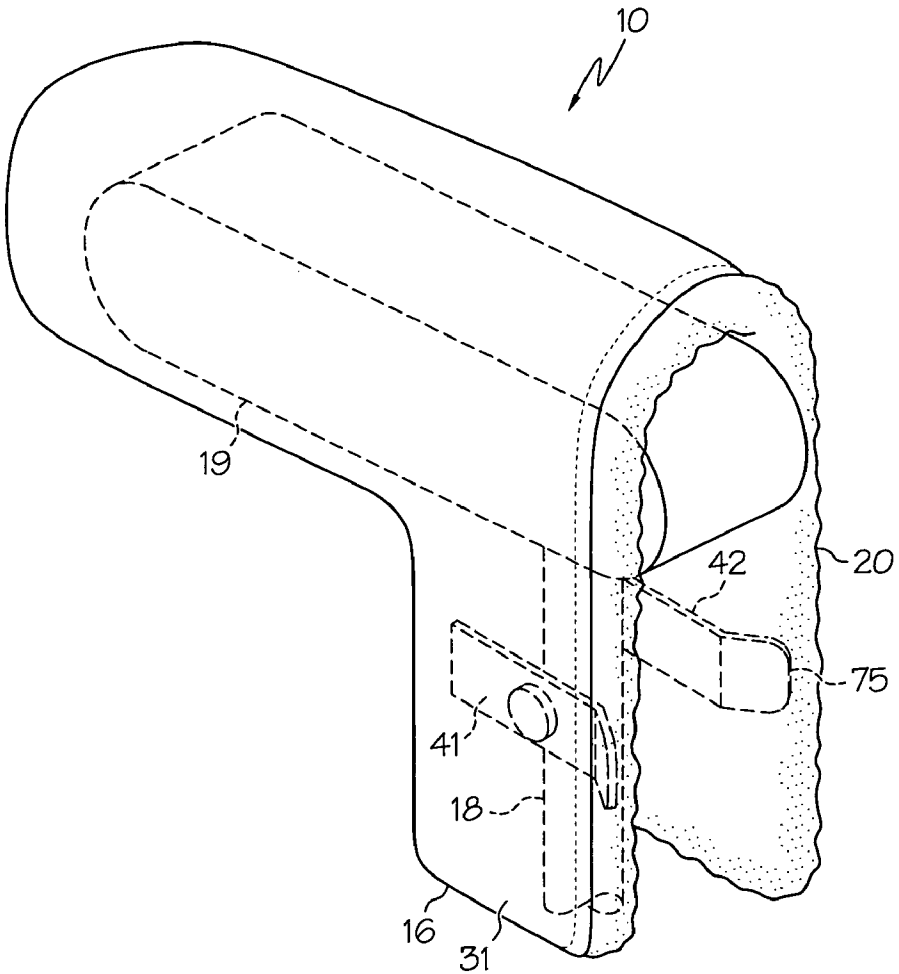
FIG. 10 is a perspective view of a golf club head cover with a golf club shaft partially positioned therein so as to move the snap closure to an open or disengaged position, according to an embodiment of the present invention.

Referring next to FIG. 10, we now see the golf club head in a general midpoint of being joined with cover 10. Compared with FIG. 9, we see in FIG. 10, that shaft 18 has now been pushed past through the y-shaped opening 75. The force exerted by the shaft 18 in this movement has caused first arm fastener 41 to disengage with or open from second arm fastener 42. In other words, the force of the club shaft 18 has overcome the magnetic force that was holding the arm fasteners closed. However, as shown in FIG. 10 the club shaft 18 has not yet completely passed through the arm fasteners 41 and 42, rather the shaft 18 is at a midpoint of travel. It is also appreciated that the human movement that has put the shaft 18 in this position has also moved shaft 18 through the opening area 20 of cover. And likewise, the head of the golf club has partially passed through notch 71.

It is here noted that in one embodiment, material is positioned proximate opening 20 that allows for an easy passage of the golf club head 19 therebetween. A smooth and low friction material can advantageously be placed on slip pads 81, 82. The slip pads 81, 82 would preferably be positioned on left flap 31 and right flap 32 on their matching surfaces. Slip pads 81, 82 also generally conform to that surface area of cover 10 which golf club head 18 contacts as it passes through opening 20 and into cavity 15. Thus, by forming slip pads 81, 82 of a low friction material, slip pads 81, 82 allow the club head 19 to pass easily into cover 10.

Figure 11:
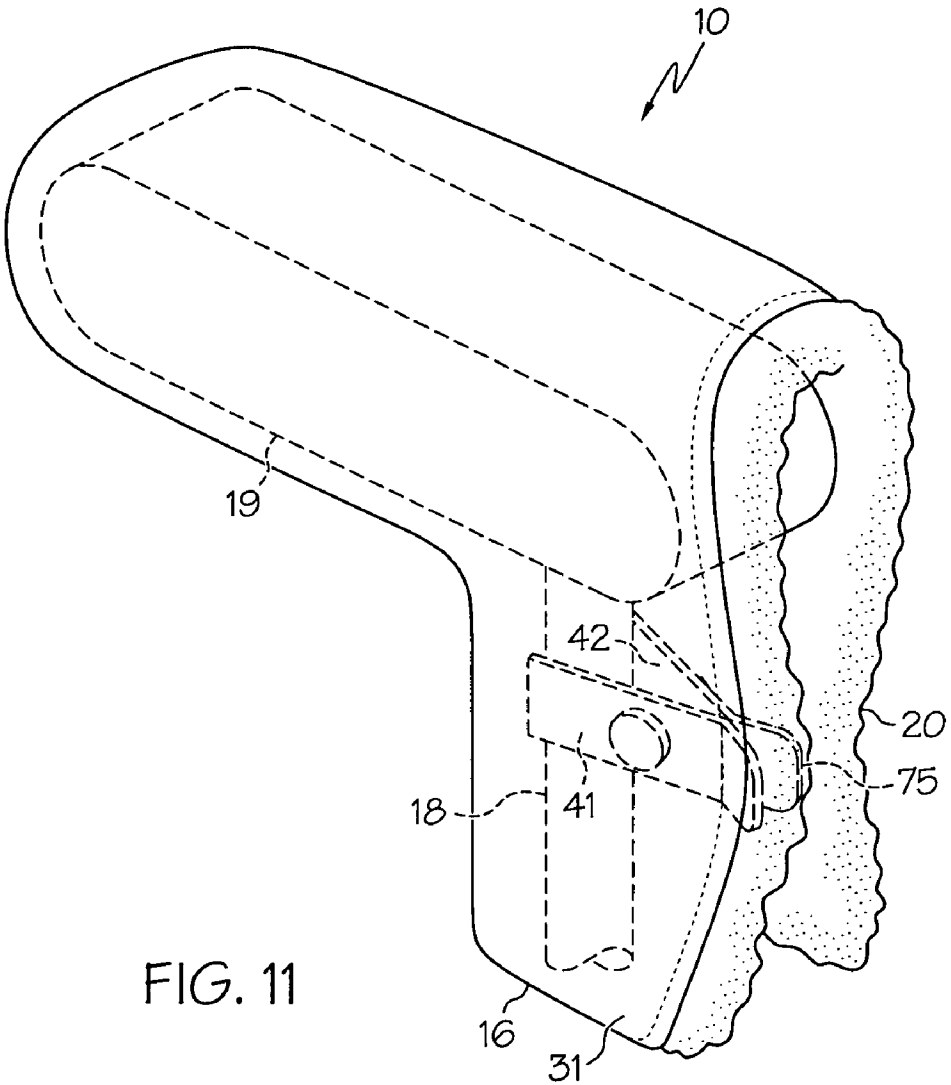
FIG. 11 is a further perspective view of a golf club head cover now secured around a golf club head, thus showing the snap closure in the closed or engaged position, according to an embodiment of the present invention.

Referring next to FIG. 11, there is shown a cover 10 now fully secured on the head of the golf club. The positions of the club head 19 and cover 10 are just extensions of the movement that began in FIG. 9 and continued in FIG. 10. Now the shaft 18 has fully passed through the snap closure 41, 42. Both the shaft 18 and the golf club head 19 have come to rest in the desired locations when the cover 10 is positioned on the golf club head 19. For example the golf club head 19 rests in cavity 15. The shaft 18 extends downwardly and exits the cover 10 through shaft opening 16. It is noted that in FIG. 11 there is nothing to obstruct the magnetic attraction between first arm fastener 41 and second arm fastener 42. These two have again joined in the engaged or closed position. In such a position left flap 31 is held close to right flap 32, which acts to securely hold the cover 10 on the golf club head 19.

Removal of the club from cover 10 is the reverse of the above steps. With a quick movement, the user pulls the golf club head 19 and shaft 18 past the closure 41, 42, momentarily opening the closure so as to allow the club to pass therethrough. The force of the club movement is sufficient to overcome the magnetic attraction which otherwise keeps the snap closure in the engaged/closed position. Once the club has exited the cover, the closure returns to the closed position.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A golf club head cover for covering the head of a golf club, the cover comprising:

a body portion defining an internal cavity for receiving a golf club head, comprising an opening therein and a interior layer;

a first flap extending from the body portion, and comprising a first pocket coupled on the interior layer;

a second flap extending from the body portion, and comprising a second pocket coupled on the interior layer;

a first arm fastener comprised within the first pocket;

a second arm fastener comprised within the second pocket;

wherein the first pocket and the second pocket enclose the first arm fastener and the second arm fastener, respectively;

wherein substantially all of a gross external shape of the first pocket and substantially all of a gross external shape of the second pocket are coupled on the first flap and on the second flap, respectively;

wherein the gross external shape of the first pocket and the gross external shape of the second pocket are configured to substantially overlap when the first flap is held against the second flap through the first arm fastener and the second arm fastener; and wherein the first arm fastener comprises a flange and at least one magnet, and wherein the second arm fastener comprises a flange and at least one magnet.

2. The golf club head cover according to claim 1 wherein the flange of the first arm fastener and the flange of the second arm fastener each comprise a curved end and the curved ends define a y-shaped opening when the first arm fastener and the second arm fastener are fully engaged.

3. The golf club head cover according to claim 1 wherein the flange of the first arm fastener and the flange of the second arm fastener comprise a first curved end and a second curved end respectively, and the first curved ends and second curved ends define a first y-shaped opening and a second y-shaped opening when the first arm fastener and the second arm fastener are fully engaged.

4. A golf club head cover comprising:

a body portion comprising an internal cavity configured to receive at least a majority of a golf club head, the body portion also comprising an interior layer;

a first flap extending from the body portion;

a second flap extending from the body portion;

a first arm fastener coupled with the interior layer of the first flap, the first arm fastener comprising a first one or more magnets; and a second arm fastener coupled with the interior layer of the second flap, the second arm fastener comprising a second one or more magnets;

wherein the first arm fastener and the second arm fastener are configured to substantially overlap when the first flap is held against the second flap through the first one or more magnets and the second one or more magnets;

wherein a portion of the first arm fastener and the second arm fastener are configured to rest against a shaft of a golf club when a golf club head is inserted into the golf club head cover and the first flap is held against the second flap; and wherein the first arm fastener and the second arm fastener each comprise a flange.

5. A method for securing a golf club head cover over the head of a golf club, the method comprising:

positioning a shaft of a golf club in a y-shaped area defined by a first arm fastener and a second arm fastener;

pushing the shaft of the golf club through the y-shaped area into an internal cavity included in the golf club head cover;

transitioning the first arm fastener and the second arm fastener from an engaged position to a disengaged position;

pushing the shaft of the golf club through and past the first arm fastener and the second arm fastener; and automatically transitioning the first arm fastener and the second arm fastener from the disengaged position to the engaged position and biasing the first arm fastener and the second arm fastener against the shaft to secure the head cover over the golf club head.

6. The method according to claim 5 further comprising passing the golf club head through a notch in the golf club head cover.

7. The method according to claim 5 further comprising removing the golf club head from the golf club head cover.

* * * * *